United States Patent [19]

Taguchi

[11] Patent Number: 5,056,143

[45] Date of Patent: Oct. 8, 1991

[54] SPEECH PROCESSING SYSTEM

[75] Inventor: Tetsu Taguchi, Tokyo, Japan

[73] Assignee: NEC Corporation, Tokyo, Japan

[21] Appl. No.: 373,013

[22] Filed: Jun. 23, 1989

Related U.S. Application Data

[63] Continuation of Ser. No. 841,657, Mar. 20, 1986, abandoned.

[30] Foreign Application Priority Data

Mar. 20, 1985 [JP] Japan ..... 60-57324
Mar. 26, 1985 [JP] Japan ..... 60-61316
Mar. 26, 1985 [JP] Japan ..... 60-61317

[51] Int. Cl.[5] ..... G10L 9/18; G10L 5/04

[52] U.S. Cl. ..... 381/35; 381/30; 381/36; 381/41

[58] Field of Search ..... 304/513.5; 381/29-51

[56] References Cited

U.S. PATENT DOCUMENTS

| | | | |
|---|---|---|---|
| 4,058,676 | 11/1977 | Wilkes et al. | 381/29 |
| 4,587,670 | 5/1986 | Levinson et al. | 381/43 |
| 4,608,708 | 8/1986 | Watanabe | 381/43 |
| 4,653,099 | 3/1987 | Kanke et al. | 381/51 |
| 4,658,424 | 4/1987 | Henderson | 381/51 |
| 4,661,915 | 4/1987 | Ott | 381/51 |
| 4,696,042 | 9/1987 | Goudie | 381/51 |
| 4,701,955 | 10/1987 | Taguchi | 381/51 |

OTHER PUBLICATIONS

Elenius et al, "Effects of Emphasizing Transitional or Stationary Parts of the Speech Signal in a Discrete Utterance Recognition System", IEEE Proceedings of the International Conf. on ASSP, 1982.

Sakoe et al, "Dynamic Programming Algorithm Optimization for Spoken Word Recognition", IEEE Trans. on ASSP, vol. ASSP-26, No. 1, 1978.

Raj Reddy & Robert Watkins, "Use of Segmentation and Labeling in Analysis-Synthesis of Speech", pp. 28-32.

John Turner & Bradley Dickinson, "A Variable Frame Length Linear Predictive Coder", pp. 454-457, 1978.

Homer Dudley, "Phonetic Pattern Recognition Vocoder for Narrow-Band Speech Transmission", pp. 733-739.

Katsuonobu Fushikida, "A Variable Frame Rate Speech Analysis-Synthesis Method Using Optimum Square Wave Approximation", pp. 385-386, May 1978.

*Primary Examiner*—Dale M. Shaw
*Assistant Examiner*—David D. Knepper
*Attorney, Agent, or Firm*—Sughrue, Mion, Zinn Macpeak & Seas

[57] ABSTRACT

A speech processing system such as a variable frame length type vocoder and a pattern matching vocoder of the same type capable of improving the reproduced speech. Representative frames replacing a plurality of frames in a given section are developed from among the frames in the given frame, or the frames in the given frame and the final representative frame developed in the preceding section. First frames to be replaced by the representative frames, and second frames, located between the neighboring different representative frames, which are to be approximated by interpolation between the neighboring different representative frames, are determined under the condition the lengths of the first and second frames be variable. In the pattern matching vocoder, the representative frames are compared with reference pattern frames and the most similar reference pattern frame is selected on the basis of measure which is obtained by summing a time distortion and a quantum distortion caused by the replacement of the frames with the representative frame and the reference pattern frame.

22 Claims, 6 Drawing Sheets

SPEECH PROCESSING SYSTEM

This is a continuation of application Ser. No. 06/841,657 filed Mar. 20, 1986 now abandoned.

BACKGROUND OF THE INVENTION

The present invention relates to a speech processing system of a variable frame length type vocoder and more particularly to improvements in reproduced speech quality.

A speech analysis and synthesis system called a "vocoder" is well known, which extracts feature parameters of an input speech signal for each frame, transmits them from an analysis side to a synthesis side with other speech information and then reproduces the speech signal by making use of the transmitted information.

A variable frame length type vocoder is also known which is capable of remarkably reducing the amount of transmission data. In this type vocoder, a plurality of frames are optimally approximated by at least one representative frame selected therefrom and the feature parameters of the representative frame and the number of frames to be replaced with the representative frame are transmitted. This vocoder is proposed by John M. Turner and Bradly W. Dickinson in a paper entitled "A Variable Frame Linear Predictive Coder", International Conference on Acoustics Speech and Signal Processing (ICASSP), 1978, pp. 454 to 457. An optimum rectangular approximation based on Dynamic Programming (DP) is reported by Katsunobu Fushikida in "A Variable Frame Rate Speech Analysis-Synthesis Method Using Optimum Square Wave Approximation", Acoustic Institute of Japan, May 1978, pp. 385 to 386. According to this technique, a predetermined number of frames are classified into a plurality of groups to minimize an error called residue distortion, between the approximated function and the envelope of the feature parameters based on rectangular approximation. The residue distortion may be expressed by space vector distance.

Further data reduction is attainable by a "pattern matching vocoder", which is disclosed in a report by Homer Dudley entitled "Phonetic Pattern Recognition Vocoder for Narrow-Band Speech Transmission", The Journal Of The Acoustical Society Of America, Vol. 30, No. 8, August, 1958, pp. 733 to 739, or a report by Raj Reddy and Robert Watkins: "Use Of Segmentation And Labelling In Analysis-Synthesis Of Speech", International Conference on Acoustics Speech and Signal Processing (ICASSP), 1977, pp. 28 to 32.

The system of the pattern matching vocoder comprises the steps of selecting the most similar reference pattern to an input feature parameter envelope pattern from among predetermined reference patterns by matching the input pattern with the respective reference patterns, and transmitting its label to the synthesis side with sound source information.

The variable frame length technique is also applicable to this pattern matching vocoder. In this vocoder, called a variable frame length type pattern matching vocoder, after determining the representative pattern from a plurality of frames the most similar reference pattern to the representative pattern is selected and then the label of the selected reference pattern is transmitted with a repeat bit indicating the number of frames to be replaced with the reference pattern. The optimum approximation is made by using rectangular and trapezoid functions on the basis of a DP matching method. The trapezoid function is comprised of a flat part and an inclination part as shown in copending and commonly assigned U.S. patent Ser. No. 544,198.

The above-described optimum approximation for each section, however, has the following shortcomings.

Since the representative frame finally selected in the preceding section and the first representative frame in the present frame are determined independently, a reduction of the approximation accuracy is unavoidable due to the lack of relation between the representative frames in the succeeding sections.

The optimum approximation by using the rectangular function also degrades the approximation accuracy, or the reproduced speech quality, due to "time distortion" which is caused by replacement of the continuous feature parameter envelope with the rectangular function.

Furthermore, the determination of the representative frame for the variable frame length process and the reference pattern for pattern matching process are carried out independently, thereby causing speech quality degradation. Here, a spectrum distortion caused by pattern matching is called "quantum distortion".

SUMMARY OF THE INVENTION

Therefore, an object of the present invention is to provide a speech processing system capable of improving the reproduced speech quality.

Another object of the present invention is to provide a speech processing system of a variable frame length vocoder capable of improving the speech quality by reducing the distortion based on the discontinuity of the representative frames in the successive sections.

Another object of the present invention is to provide a speech processing system capable of improving the speech quality by reducing the distortion caused by replacement of the feature parameter envelope with the step, or rectangular function.

Another object of the present invention is to provide a speech processing system of the pattern matching type vocoder capable of improving the speech quality.

According to one aspect of the present invention, there is provided a speech processing system, comprising: a first process of extracting feature parameters of a speech signal for each predetermined frame; a second process of developing at least one representative frame which approximates a plurality of frames included in a present section from among the frames in the present section and a final representative frame developed in a preceding section; a third process of generating the information of the representative frame and the number of frames to be replaced with the representative frame.

According to another aspect of the present invention, there is provided a speech processing system, comprising: a first process of extracting feature parameters of a speech signal for each predetermined frame; a second process of developing representative frames each replacing a plurality of frames, frames to be replaced with said representative frames and at least one frame located between different representative frames to be interpolated by the different representative frames; and a third process of generating the information of the representative frames, the number of frames to be replaced with said representative frames, and the frames to be interpolated.

According to another aspect of the present invention, there is provided a speech processing system comprising: a first process of extracting feature parameters of a speech signal for each predetermined frame; a second process of developing at least one representative frame which approximates a plurality of frames for each section; and a third process of determining a reference pattern having the minimum distance to the developed representative frame and generating the information of the reference pattern and the number of frames to be replaced with the reference pattern on the basis of a measure which is obtained by summing a time distortion and a quantum distortion caused by replacements of the frame with the representative frame and the reference pattern frame, respectively.

Other objects and features of the present invention will be clarified from the following explanation with reference to the drawings.

DETAILED DESCRIPTION OF THE PREFERRED EMBODIMENT

Figure 1:
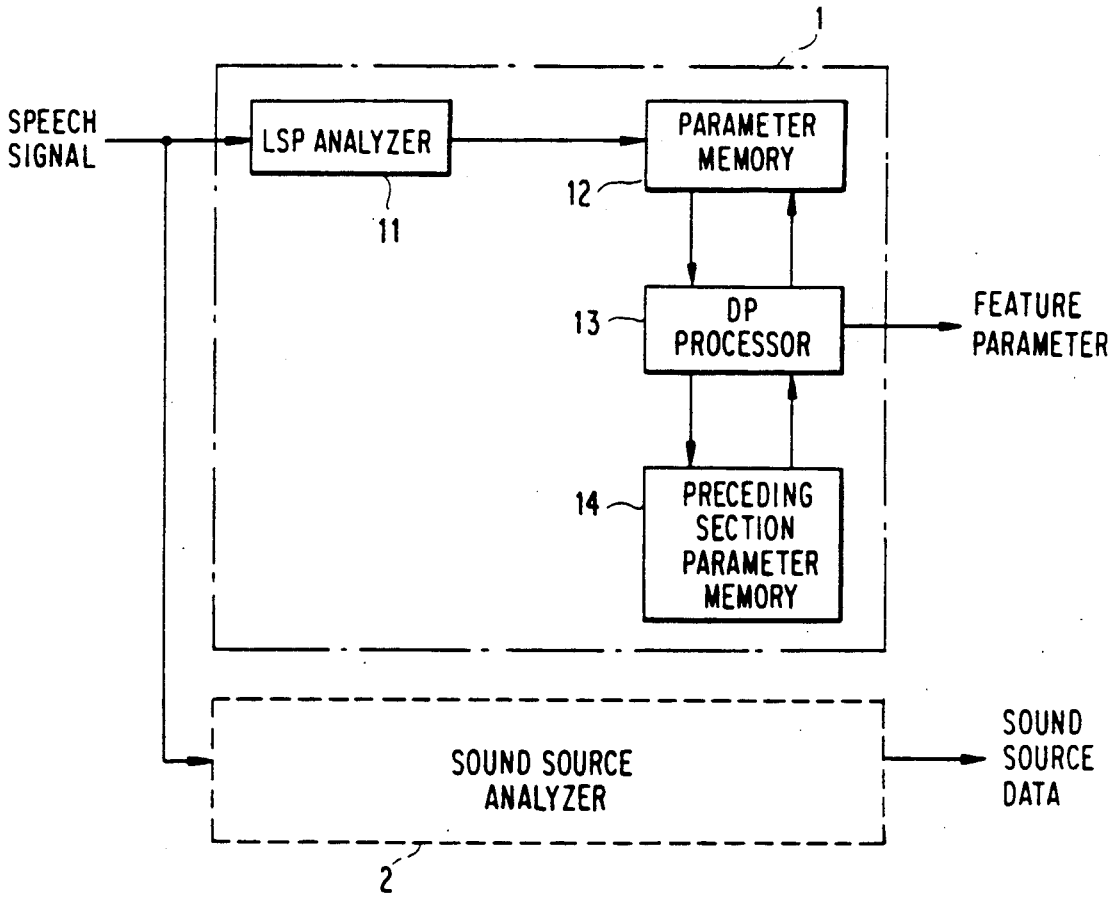
FIG. 1 shows a block diagram of one embodiment of the variable frame length vocoder according to the present invention.

As shown in FIG. 1, in one embodiment of the present invention a sectional optimum approximator 1 and a sound source analyzer 2 are provided at the analysis side of the vocoder. The approximator 1 includes an LSP (Line Spectrum Pair) analyzer 11, a parameter memory 12, DP processor 13 and a preceding section parameter memory 14.

The LSP analyzer 11 calculates LPC coefficients for each analyzing frame of an input speech and develops LSP parameters from thus obtained LPC coefficients by using the well known Newton's recursive method. In the parameter memory 12, LSP parameters are memorized as a feature vector of the input speech. The DP processor 13 performs a sectional optimum approximation, as described below on parameters for each section including a plurality of frames. The preceding section parameter memory 14 stores the LSP parameters of the representative frames selected in the preceding section.

This embodiment takes into consideration the selected frame information in the preceding section for the processing in the present section. This makes it possible to reduce the residue distortion and improve the reproduced speech quality.

The obtained feature (LSP) parameter data are transmitted to a synthesis side through a transmission line with the sound source data such as amplitude, pitch period and voice/unvoiced discrimination data extracted by the sound source analyzer 2.

Figure 2:
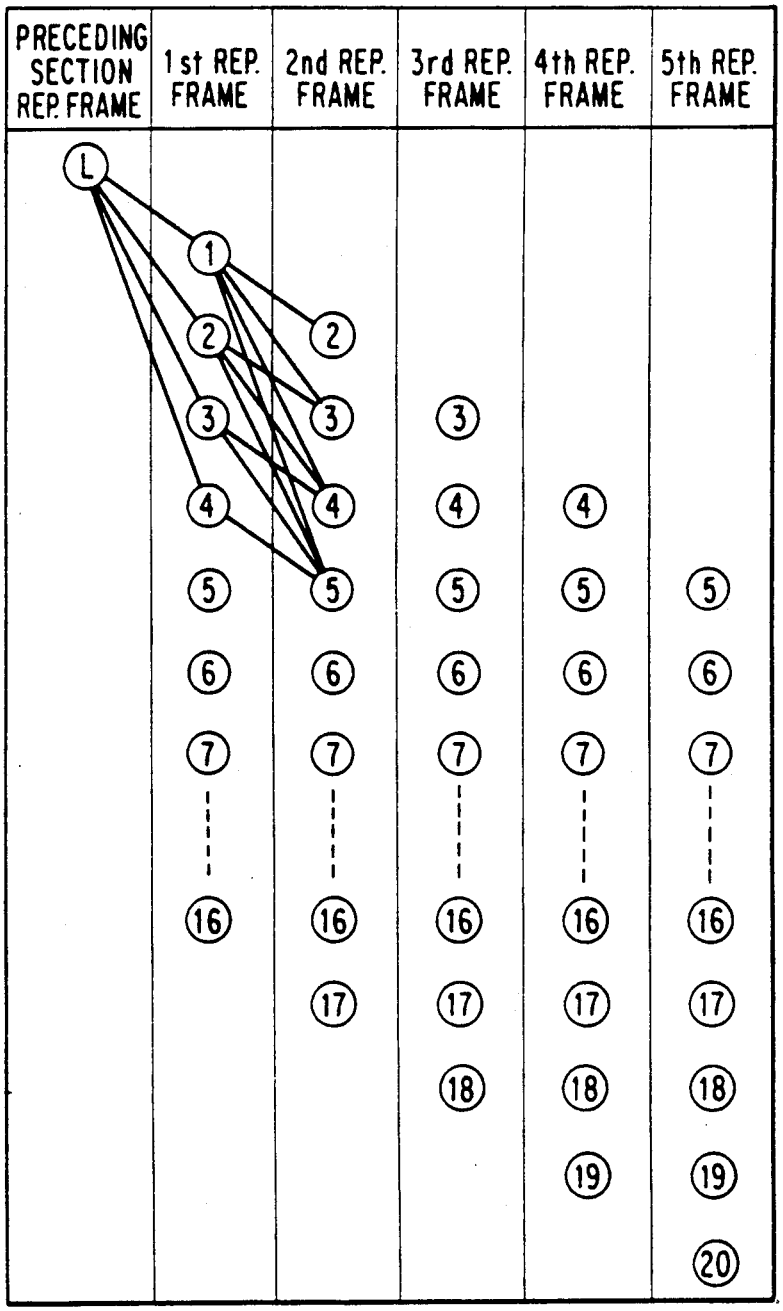
FIG. 2 shows a diagram for explaining the optimum approximation according to the present invention.

The operation of the DP processor 13 will be described with reference to FIG. 2. FIG. 2 is a diagram for explaining the operation where the analysis frame period is 10 msec; the section length, 200 msec; and the number of the representative frames, 5. In FIG. 2, L indicates the final representative frame in the preceding section and #1 through #20 the frame numbers in the present section.

The DP processor 13 selects five representative parameter vectors (representative frames) and determines frames to be replaced with the representative frame. As the first representative frame one of the frames #1 through #16 is selectable. Similarly, the frames #5 through #20 are candidates for the fifth representative frame. Listed as candidates for the second, third and fourth representative frames are the frames #2 through #17, #3 through #18 and #4 through #19, respectively.

Now assuming the frame #1 is selected as the first representative frame, one of the frames #2 through #17 are selectable as the second representative frame.

The spectrum distortion (time distortion) is expressed by a spectrum distance between the representative frame and the frames to be replaced, as shown in Equation (1):

$$d_{i,j} \approx \sum_{k=1}^{N} W_k \{P_k^{(i)} - P_k^{(j)}\}^2 \tag{1}$$

where i and j represent the frame numbers of the representative frame and the frame to be replaced, respectively, for the calculation of $d_{i,j}$; N, the number of feature parameter vector elements: $W_k$, spectral sensitivity which is determined according to each feature parameter; and $P_k^{(i)}$ and $P_k^{(j)}$, feature parameter vector elements for the frames #i and #j. When the frames #1 and #2 are determined as the first and second representative frames, there is no time distortion with respect to the first or second frames because of no replacement. On the other hand, when the frame #3 is selected as the second representative frame, the minimum total distortion incurred in the first three frames is expressed by $D_3^{(2)}$ in Equation (2):

$$D_3^{(2)} = \min \begin{cases} D_1^{(1)} + D_{1,3} \\ D_2^{(1)} + D_{2,3} \end{cases} \tag{2}$$

where $D_1^{(1)}$ and $D_2^{(1)}$ represent total distortion when the frames #1 and #2 are selected as the first representative frame.

The total distortions for the first representative frame are developed according to Equation (3):

$$\begin{aligned} D_1^{(1)} &= O \\ D_2^{(1)} &= D_{L,2} \\ &\vdots \\ D_{16}^{(1)} &= D_{L,16} \end{aligned} \tag{3}$$

where $D_1^{(1)}$ to $D_{16}^{(1)}$ show total distortions for the respective frames #1 to #16, respectively; and $D_{L,2}$ to $D_{L,16}$, total distortions defined by the following Equations (4) through (5).

$$D_{L,2} = \min \begin{matrix} d_{L,1} \\ d_{2,1} \end{matrix} \tag{4}$$

$$\vdots$$

$$D_{L,16} = \min \begin{cases} \sum_{i=1}^{15} d_{L,i} \\ \sum_{i=1}^{14} d_{L,i} + d_{16,15} \\ \sum_{i=1}^{13} d_{L,i} + \sum_{j=14}^{15} d_{16,j} \\ \vdots \\ \sum_{i=1}^{2} d_{L,i} + \sum_{j=3}^{15} d_{16,j} \\ d_{L,1} + \sum_{j=2}^{15} d_{16,j} \end{cases} \tag{5}$$

where $d_{L,1}$ and $d_{L,i}$ represent time distortions between the frames #L and #1, and #L and #i, respectively.

The second embodiment of the present invention reduces the distortion due to the replacement of the feature vector envelope of the section with the rectangular function by approximating the section by a trapezoid function having variable flat and inclined portions.

In this embodiment, Equations (4) and (5) are substituted by Equations (4a) through (5a):

$$D_{L,2} = \min \begin{cases} d_{L,1} \\ q_{1,2,L} \end{cases} = \min \begin{cases} d_{L,1} \\ d_{2,1} \\ d_{(1-2,1-2),1} \end{cases} \tag{4a}$$

$$d_{L,16} = \min \begin{cases} \sum_{i=1}^{15} d_{L,i} \\ \sum_{i=1}^{14} d_{L,i} + q_{15,16,L} \\ \sum_{i=1}^{13} d_{L,i} + q_{14,16,L} \\ \vdots \\ \sum_{i=1}^{2} d_{L,i} + q_{3,16,L} \\ d_{L,i} + q_{2,16,L} \end{cases} \tag{5a}$$

where $q_{15,16,L}$ indicates the minimum time distortion due to the replacement of the feature parameter vector of the frame #15 with that of the frame #16 or the interpolated vector between the frames #16 and #L as expressed by Equation (6a):

$$q_{15,16,L} = \min \begin{cases} d_{16,15} \\ d_{(1-L,1-16),15} \end{cases} \tag{6a}$$

where $d_{(1-L,1-16),15}$ is a spectrum distance between the vector of the frame #15 and the interpolated vector $\pi_{(1-L,1-16)}$ as shown in Equation (6b):

$$\pi_{(1-L,1-16)} = \frac{1 \cdot P_1^{(L)} + 1 \cdot P_1^{(L)}}{1+1} \cdot \frac{1 \cdot P_2^{(L)} + 1 \cdot P_2^{(16)}}{1+1} \cdots \frac{1 \cdot P_N^{(L)} + 1 \cdot P_N^{(16)}}{1+1} \tag{6b}$$

In a similar way, $q_{14,16,L}$ may be expressed by Equation (6c) representing the minimum time distortion due to the replacement of the frames #14, #15 with the frame #16 or the frame linearly interpolated between the frames #16 and #L:

$$q_{19,16,L} = \min \begin{cases} \sum_{i=14}^{15} d_{16,i} \\ d_{16,15} = d_{(1-L,1-16),14} \\ \sum_{i=14}^{15} d_{((16-i)-L,(i-13)-16),i} \end{cases} \tag{6c}$$

where $d_{(1-L,1-16),14}$ is obtainable in a similar way to that described above using Equation (6b), and $$\sum_{i=14}^{15} d_{((16-i)-L,(i-13)-16),i}$$

is a sum value of $d_{(2-L,1-16),14}$ and $d_{(1-L,2-16),15}$ which are frame replacement distortions between the vectors of the frames #14, #15 and the interpolated vectors $\pi_{(2-L,1-16)}$, $\pi_{(1-L,2-16)}$ expressed by Equations (6d) and (6e), respectively:

$$\pi_{(2-L,1-16)} = \frac{2 \cdot P_1^{(L)} + 1 \cdot P_1^{(16)}}{2+1} \cdot \frac{2 \cdot P_2^{(L)} + 1 \cdot P_2^{(16)}}{2+1} \cdots \frac{2 \cdot P_N^{(L)} + 1 \cdot P_N^{(16)}}{2+1} \tag{6d}$$

$$\pi_{(2-L,1-16)} = \frac{1 \cdot P_1^{(L)} + 2 \cdot P_1^{(16)}}{1+2} \cdot \frac{1 \cdot P_2^{(L)} + 2 \cdot P_2^{(16)}}{1+2} \cdots \frac{1 \cdot P_N^{(L)} + 1 \cdot 2_N^{(16)}}{1+2} \tag{6e}$$

Similarly, $q_{3,16,L}$ and $q_{2,16,L}$ are the minimum distortions obtained by replacing the frames #4–#15, #3–#15 with the frame #16 or the frame linearly interpolated between the frames #16 and #L.

Now, returning to the explanation regarding Equation (2), $D_{1,3}$ represents the distortion where the frames #1–#3 are optimally approximated by the representative frames #1 and #3 and is shown by Equation (6).

$$D_{1,3} = \min \begin{cases} d_{1,2} \\ q_{2,3,1} \end{cases} = \min \begin{cases} d_{1,2} \\ d_{3,2} \\ d_{(1-1,1-3),2} \end{cases} \tag{6}$$

$D_{2,3}=0$ because there is no frame to be replaced between the frames #2 and #3.

Considering the minimum total distortion $D_4^{(2)}$ where the frame #4 is selected as the second representative frame, the frames #1, #2 and #3 are selectable as the first representative frame and the minimum total distortion $D_4^{(2)}$ is expressed as follows:

$$D_4^{(2)} = \min \begin{cases} D_1^{(1)} + D_{1,4} \\ D_2^{(1)} + D_{2,4} \\ D_3^{(1)} + D_{3,4} \end{cases} \tag{7}$$

where $D_{1,4}$, $D_{2,4}$ and $D_{3,4}$ represent time distortions and, for example, $D_{1,4}$ may be expressed by Equation (8):

$$D_{1,4} = \min \begin{cases} \sum_{j=2}^{3} d_{1,j} \\ d_{1,2} + d_{4,3} \\ \sum_{j=2}^{3} d_{4,j} \end{cases} \tag{8}$$

where $d_{1,2}$, $d_{1,3}$ are time distortions when the frames #2 and #3, respectively, are replaced with the frame #1 and $d_{4,3}$ is the time distortion when frame #3 is replaced with frame #4, respectively.

In the second embodiment, $D_{1,4}$, $D_{2,4}$ and $D_{3,4}$ in Equation (7) are time distortions and, for example, $D_{1,4}$ may be expressed by the following Equation (8a):

$$D_{1,4} = \min \begin{cases} \sum_{i=2}^{3} d_{1,i} \\ d_{1,2} + q_{3,4,1} \\ q_{2,4,1} \end{cases} \tag{8a}$$

where $q_{3,4,1}$ indicates the minimum time distortion when the frame #3 is replaced with the frame #4 or the frame interpolated from the frames #4 and #1; and $q_{2,4,1}$, the minimum time distortion when the frames #2 and #3 are replaced with the frame #4 or the linearly interpolated frame by the frames #4 and #1, $D_{2,4}$ and $D_{3,4}$ may be also be defined in a manner similar to the definition of $D_{1,4}$.

Now, it can be seen from Equation (7) that when the frame #4 is determined as the second representative frame, the time distortion will be a function of which of frames #1-#3 is selected as the first representative frame and a combination of the frames to be replaced with the first and second representative frames.

Thus the total time distortions up to the fifth representative frame expressed by Equations (2) and (7) are succeedingly calculated for the first through the fifth representative frames. The total time distortion is used as a measure for developing the optimum approximation function. Namely, the total time distortions are developed up to the fifth representative frame under the condition that the preceding one of the frames #1 through #4 is selectable as the first representative frame where the frame #5 is selected as the second representative frame. The following calculation for the frames #5 through #20 selected as the fifth representative frame are then carried out:

$$D_l = \min \begin{cases} D_5^{(5)} + \sum_{i=6}^{20} d_{5,i} \\ D_6^{(5)} + \sum_{i=7}^{20} d_{6,i} \\ \vdots \\ D_{19}^{(5)} + d_{19,20} \\ D_{20}^{(5)} \end{cases} \tag{9}$$

According to Equation (9), the minimum total distortion as to other frames represented by one of the frames #5 through #20 selected as the fifth representative frame is determined. $D_5^{(5)}$ through $D_{20}^{(5)}$ are total distortions when one of the frames #5 through #20 are determined as the fifth representative frame;

$$\sum_{i=6}^{20} d_{5,i},$$

the total time distortion between the frame #5 and the frames #7 through #20; and $d_{19,20}$, the time distortion between the frames #19 and #20.

After developing $D_l$ for each section based on Equation (9), five representative frames and frames to be replaced with the representative frames are determined on the basis of a DP path minimizing the total time distortion from among a plurality of combinations of the first through fifth representative frames.

Thus, a variable frame length vocoder system is realized. More specifically, according to the first embodiment, the first representative frame in the present section can be replaced with the final representative frame in the preceding section, thereby improving the discontinuity problem between the successive sections.

Further, according to the second embodiment using the trapezoid approximation, the lengths of which flat and inclined portions are variable, the distortion can be remarkably reduced compared with that using the rectangular approximation.

In the aforesaid description of the second embodiment, it will be clearly understood that the following Equation (10) can be used instead of Equation (3). The parameter memory 14 may be eliminated according to this case.

$$\begin{aligned} D_1^{(1)} &= 0 \\ D_2^{(1)} &= d_{2,1} \\ D_3^{(1)} &= \sum_{i=1}^{2} d_{3,i} \\ &\vdots \\ D_{16}^{(1)} &= \sum_{i=1}^{15} d_{16,i} \end{aligned} \tag{10}$$

Figure 3:
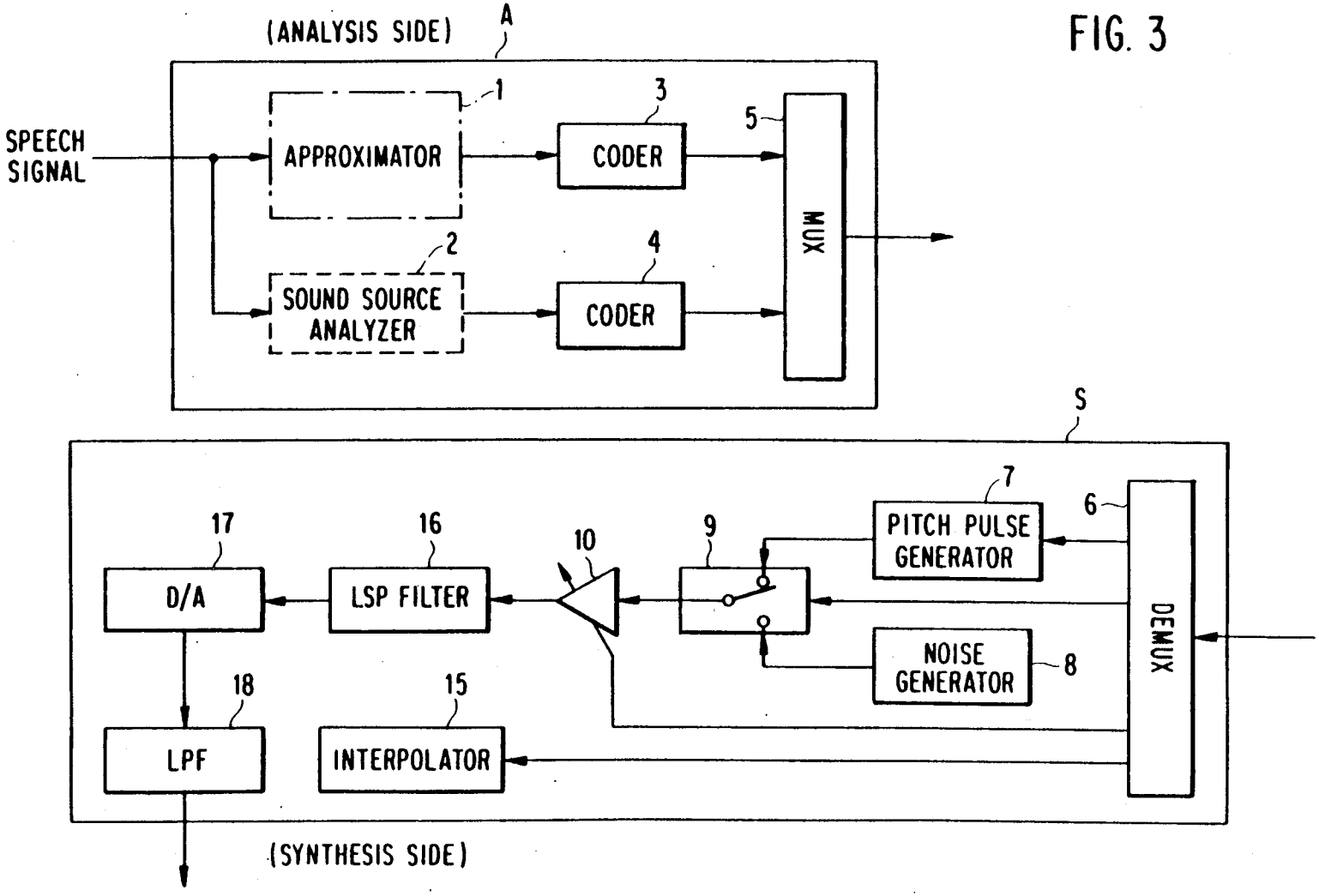
FIG. 3 shows one example of vocoder according to the present invention.

FIG. 3 shows, by way of example, a block diagram of the variable frame length type vocoder. An analysis side A comprises the sectional optimum function approximator 1, the sound source analyzer 2, coders 3 and 4, and a multiplexer 5. The synthesis side S includes a demultiplexer 6, a pitch pulse generator 7, a noise generator 8, a switch 9, a variable gain amplifier 10, an interpolator 15, an LSP synthesis filter 16, a D/A converter 17 and an LPF (Low Pass Filter) 18.

The approximator 1 and the sound source analyzer 2 generate the feature parameter vector data and the sound source data as explained before. After being coded in the coders 3 and 4 and multiplexed in the multiplexer 5, these data are transmitted to the synthesis side S through the transmission line. The approximator 1 performs sectional optimum approximation based on the aforementioned processing for data compression and generates LSP coefficients as the feature parameters. Specifically, the representative frames, the number of frames to be replaced with the representative frames and other information such as the lengths of the flat and inclined parts are generated from the approximator 1.

At the synthesis side, the transmitted data are demultiplexed in the demultiplex 6. Of these demultiplexed data, the feature parameter data are supplied to the interpolator 15, and the pitch data, voiced/unvoiced discrimation data and sound strength data are supplied to the pitch pulse generator 7, the switch 9 and the variable gain amplifier 10, respectively.

The interpolator 15 generates the interpolated LSP coefficients by using those of the representative frames and frame information to be replaced with the representative frame, and supplies these to the LSP synthesis filter 16.

The switch 9 produces the output from the pitch pulse generator 7 or the noise generator 8 in response to the voiced/unvoiced discrimination data. The gain of the amplifier 10 is controlled by the sound strength data and supplies the amplified pitch pulse or noise signal to the LSP synthesis filter 16. The LSP synthesis filter 16 then reproduces a digital speech signal. An analog speech signal is then generated through the D/A converter 17 and the LPF 18.

A third embodiment of the invention provides an improvement of the variable frame length type pattern-matching vocoder.

Figure 4:
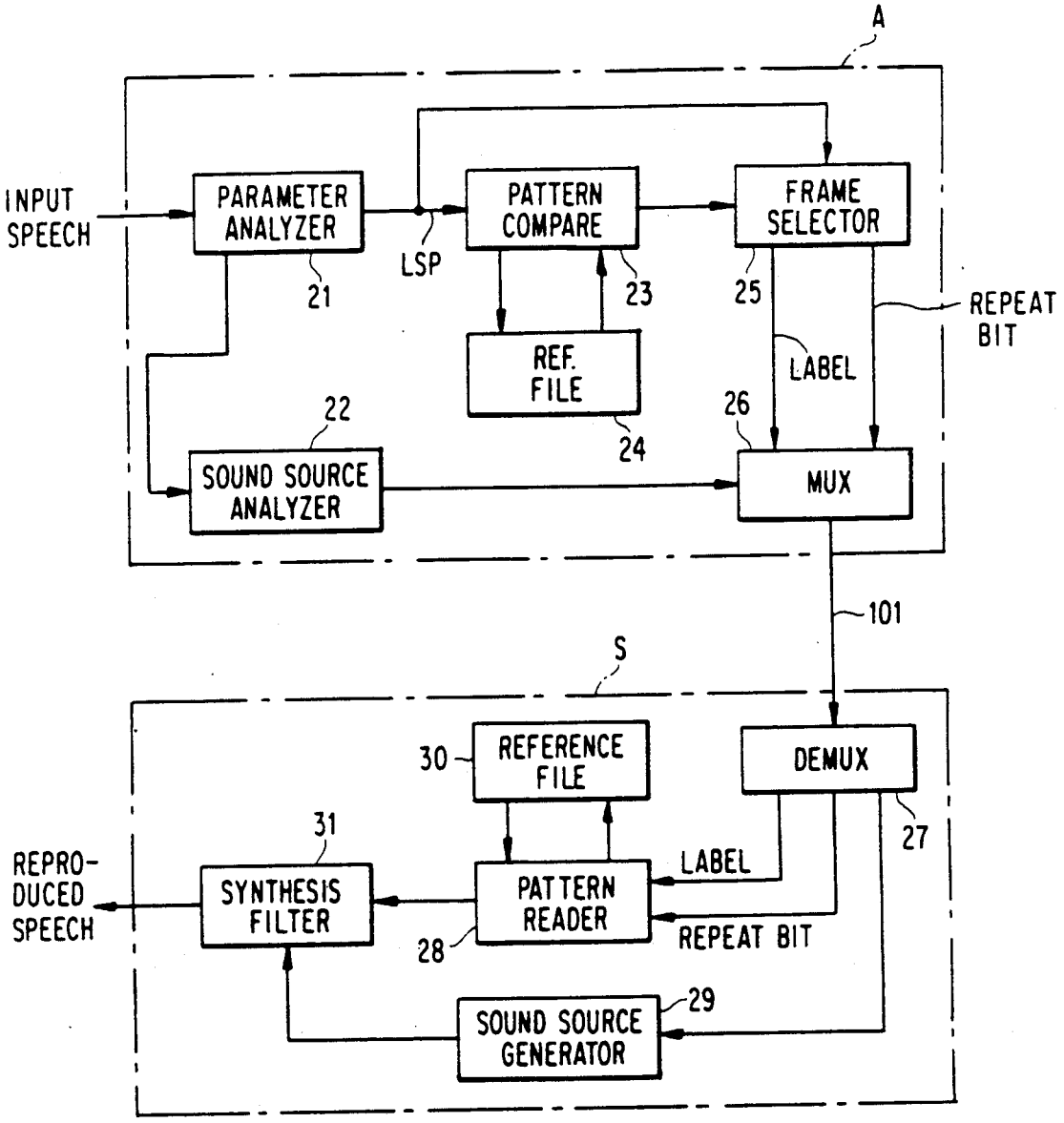
FIG. 4 shows a block diagram of the pattern matching type vocoder according to another embodiment of the present invention.

FIG. 4 shows, by way of example, a block diagram of this type vocoder. An analysis side A comprises a parameter analyzer 21, a sound source analyzer 22, a pattern comparator 23, a reference pattern file 24, a frame selector 25 and a multiplexer 26. A synthesis side S includes a demultiplexer 27, a pattern reader 28, a sound source generator 29, a reference pattern file 30 and a synthesis filter 31.

An input speech signal is inputted to well-known parameter analyzer 21 and to the sound source analyzer 22. The pattern comparator 23 compares the input pattern with a reference pattern and selects a reference pattern having the minimum spectrum distance to the input pattern. The minimum spectrum distance is defined as $D_Q^{(q)}$ in Equation (11):

$$D_Q^{(q)} = \min \begin{cases} \sum_{k=1}^{N} W_k(P_k^{(Q)} - P_k^{(S1)})^2 \\ \sum_{k=1}^{N} W_k(P_k^{(Q)} - P_k^{(S2)})^2 \\ \sum_{k=1}^{N} W_k(P_k - P_k^{(SR)}) \\ \sum_{k=1}^{N} W_k(P_k - P_k^{(SM)}) \end{cases} \quad (11)$$

where $W_k$ = a spectrum sensitivity of LSP coefficient

N = an LSP analysis order $P_k^{(Q)}$ = a spectrum envelop pattern of the frame

Q = the number of frame included in the section and Q = 1,2, . . . K

R = 1 through M

M = total number of spectrum reference patterns $P_k^{(S1)}$ through $P_k^{(SM)}$ first through Mth spectrum envelop reference patterns The selected reference pattern and specific code specifying the selected reference pattern and $D_Q^{(q)}$ are applied to the frame selector 25 as a reference pattern parameter, a label and a quantum distortion. It is noted here that $D_Q^{(q)}$ represents a spectrum distance between the two patterns, called quantum distortion.

The frame selector 25 is provided with LSP coefficient supplied from the parameter analyzer 21 and determines representative frames by using a DP method as described with respect to the first and second embodiments.

Figure 5:
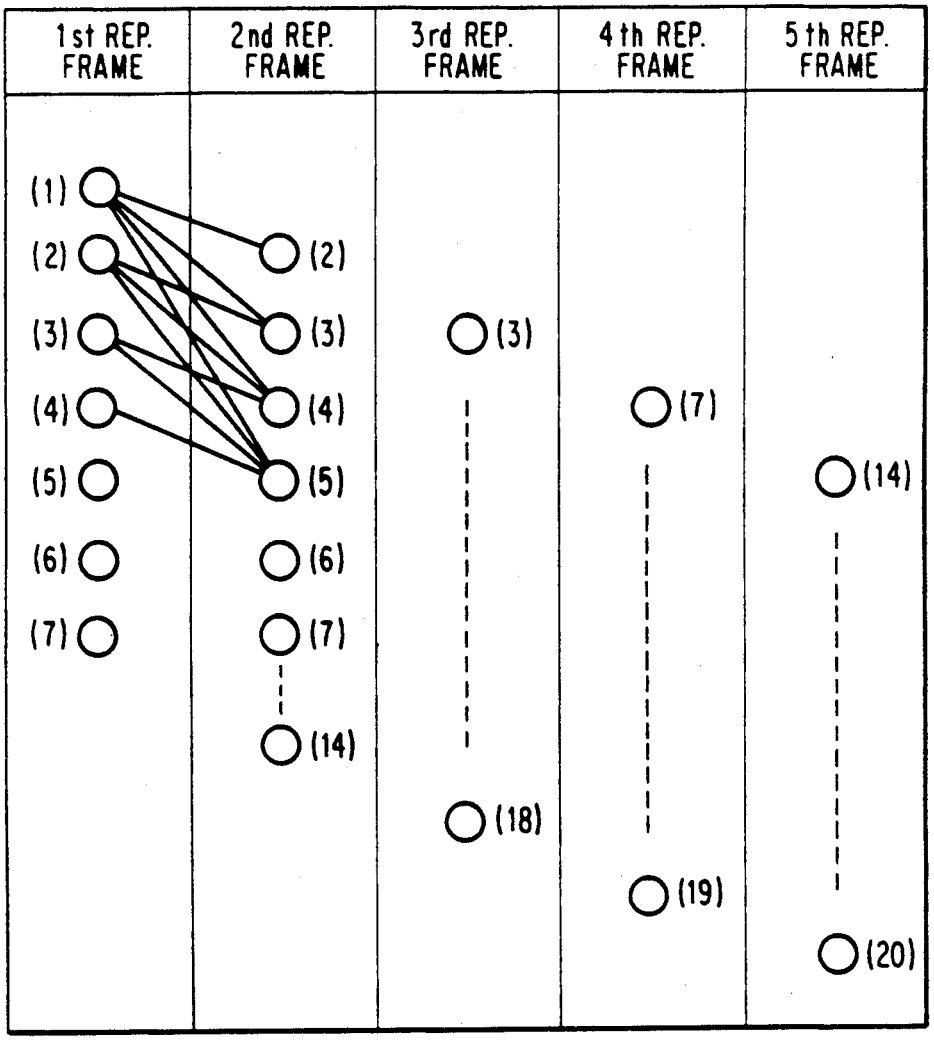
FIG. 5 shows a diagram for explaining the pattern matching in FIG. 4.

FIG. 5 is a diagram for explaining the frame selection based on the DP method using rectangular approximation where the frame length is 10 msec; the section length, 200 msec; and the number of representative frames, #5. In this embodiment, two restrictions are provided for determining the first through fifth representative frames. One restriction is that the maximum number of frames in each of the preceding and the following frames to be replaced with the representative frame be set at six. Accordingly, up to 13 continuous frames can be represented by one representative frame. Another restriction is that the maximum interval between consecutive representative frames be set at seven.

The frames #1 through #7 and #14 through #20 are selectable as the first and fifth representative frames, respectively. Similarly, as the second representative frame, the frames #2 through #14 are selectable because of the following reason. Assuming the frame #1 is the first representative frame, one of the frames #2 through #8 is selectable as the second representative frame. If the first representative frame is the frame #2, one of the frames #3 through #9 will be determined as the second representative frame. Similarly, if the first representative frame is the frame #7, one of the frames #8 through #14 is selected as the second representative frame. As a result, the frames selectable as the second representative frame are #2 through #14.

As a result of the maximum interval restrictions, one of the frames #7 through #19 is selectable as the fourth representative frame. The frames to be selected as the third representative frame are limited by both the second and fourth representative frames. In other words, it is necessary that the third representative frame exist between the second and the fourth representative frames.

Similarly, one of the frames #3 through #18 is determined as the third representative frame when taking into consideration the maximum interval restriction with respect to the second and fourth representative frames and the selection possibility of the neighboring frames.

The sum value of the determined time distortion and quantum distortion is used as an estimated measure in this embodiment.

Now assuming the frame #3 is selected as the second representative frame, $D_3^{(2)}$ is defined as the minimum distortion as follows:

$$D_3^{(2)} = \min\begin{Bmatrix} D_1^{(1)} + D_{1,3} \\ D_2^{(1)} + D_{2,3} \end{Bmatrix} + D_3^{(q)} \tag{12}$$

where $D_3^{(2)}$ indicates the total distortion when the frame #3 is selected as the second representative frame; and $D_1^{(1)}$ and $D_2^{(1)}$, the total distortions when the frames #1 and #2 are selected as the first representative frame.

The total distortion when the frames #1 through #7 are determined as the first representative frame is expressed by Equation (13):

$$\begin{aligned} D_1^{(1)} &= D_1^{(q)} \\ D_2^{(1)} &= d_{2,1} + D_2^{(q)} \\ D_3^{(1)} &= \sum_{i=1}^{2} d_{3,1} + D_3^{(q)} \\ &\vdots \\ D_t^{(1)} &= \sum_{i=1}^{t-1} d_{t,i} + D_t^{(q)} \\ D_7^{(1)} &= \sum_{i=1}^{6} d_{7,1} + D_7^{(q)} \end{aligned} \tag{13}$$

where:

$D_1^{(1)} - D_7^{(1)}$ = total distortions of the respective frames #1 through #7

$D_1^{(q)} - D_7^{(q)}$ = quantum distortions of the respective frames #1 through #7

$d_{2,1}$ = time distortion between the frame #1 and the frame #2 which is replaced with the optimum reference pattern $\sum_{i=1}^{2} d_{3,i}$ = summed time distortion between the frames #1, #2 and the frame #3 replaced with the optimum reference pattern $\sum_{i-1}^{6} d_{7,i}$ = summed time distortion between the frames #1 through #6 and the frame #7 replaced with the optimum reference pattern $D_3^{(q)}$ = quantum distortion of the frame #3

In Equation (12), $D_{1,3}$ represents the smaller time distortion of the two distortions defined by Equation (14); and $D_{2,3}$, time distortion when the frames #2 and #3 are selected as the first and second representative frames (in this case $D_{2,3}=0$ since there exists no frame between the frames #2 and #3).

$$D_{1,3} = \min\begin{Bmatrix} d_{1,2} \\ d_{3,2} \end{Bmatrix} \tag{14}$$

where $d_{1,2}$ and $d_{3,2}$ show spectrum distances between the frame #2 and the frames #1, #3 replaced with the reference pattern.

According to Equation (12), the smaller distortion is selected from among the distortions obtained when the frames #1 and #2 are determined as the first representative frame under the condition that the third frame be selected as the second representative frame.

Next, as the first representative frame the frames #1, #2 and #3 are selectable when the frame #4 is determined as the second representative frame. The total distortion $D_4^{(2)}$ is expressed by Equation (15):

$$D_4^{(2)} = \min\begin{Bmatrix} D_1^{(1)} + D_{1,4} \\ D_2^{(1)} + D_{2,4} \\ D_3^{(1)} + D_{3,4} \end{Bmatrix} + D_4^{(q)} \tag{15}$$

where $D_{1,4}$, $D_{2,4}$ and $D_{3,4}$ are time distortions; and $D_4^{(q)}$, a quantum distortion for the frame #4. $D_{1,4}$ is, for example, expressed by Equation (16):

$$D_{1,4} = \min\begin{Bmatrix} d_{1,2} + d_{1,3} \\ d_{1,2} + d_{4,3} \\ d_{4,2} + d_{4,3} \end{Bmatrix} \tag{16}$$

It will be easily understood from Equation (15) that, if the frame #4 is determined as the second representative frame, a combination of the first representative frame and the frames to be replaced with the first and second representative frames are developed. In this manner, the total distortions up to the fifth representative frames are succeedingly developed. The following operation is carried out for the frames #14 through #20 selectable as the fifth representative frame.

$$D_l = \min\begin{Bmatrix} D_{14}^{(5)} + \sum_{i=15}^{20} d_{14,i} \\ D_{15}^{(5)} + \sum_{i=16}^{20} d_{15,i} \\ \vdots \\ D_{19}^{(5)} + d_{19,20} \\ D_{20}^{(5)} \end{Bmatrix} \tag{17}$$

where $D_{14}^{(5)} - D_{20}^{(5)}$ = total distortions when the frames designated by the subscript are selected as the fifth representative frame $\sum_{i=15}^{20} d_{14,i}$ and $\sum_{i=16}^{20} d_{15,i}$ = total time distortions of the frames #15 to #20 and #16 to #20 from the frames #14 and #15 replaced with the reference pattern, respectively -continued $d_{19,20}$ = time distortion between the frame #20 and the frame #19 replaced with the reference pattern After determining $D_l$ for each section, five representative frames and the frames to be replaced are developed on the basis of the DP path showing the minimum total distortion. This development is based on the measure of the total distortion which is obtained by summing the quantum distortion and the time distortion. The representative frames are substituted by the label data corresponding to the spectrum envelope reference pattern. The label data is supplied to the multiplexer 26 with the repeat bit data.

Returning to FIG. 4, the sound source analyzer 12 applies the sound strength and voiced/unvoiced discrimination data and the pitch data to the multiplexer 26 as the sound source data. The multiplexer 26 codes and multiplexes the input data and transmits them to the synthesis side through the transmission line.

At the synthesis side S, the multiplexed data are demultiplexed and decoded in the demultiplexer 27. The label and repeat bit data are supplied to the pattern reader 28 and the sound source data supplied to the sound source generator 29. The pattern reader 28 reads out the spectrum envelop reference pattern corresponding to the label data from the reference pattern file 30 and sends the read out data to the synthesis filter 31 repeatedly as specified by the repeat bit data. The reference pattern file 30 stores the same contents as the pattern comparator 23 in this embodiment.

The sound source generator 29 generates the pulse train of the pitch period specified by the pitch period data and white noise responsive to the unvoiced discrimination data. The synthesis filter 31, as is well known, generates a digital signal. The output of the filter 31 is converted into a analog signal through the D/A converter and LPF. According to this embodiment, the speech quality is remarkably improved since the distortions caused by the frame selection and pattern matching processings are taken into consideration together.

Figure 6:
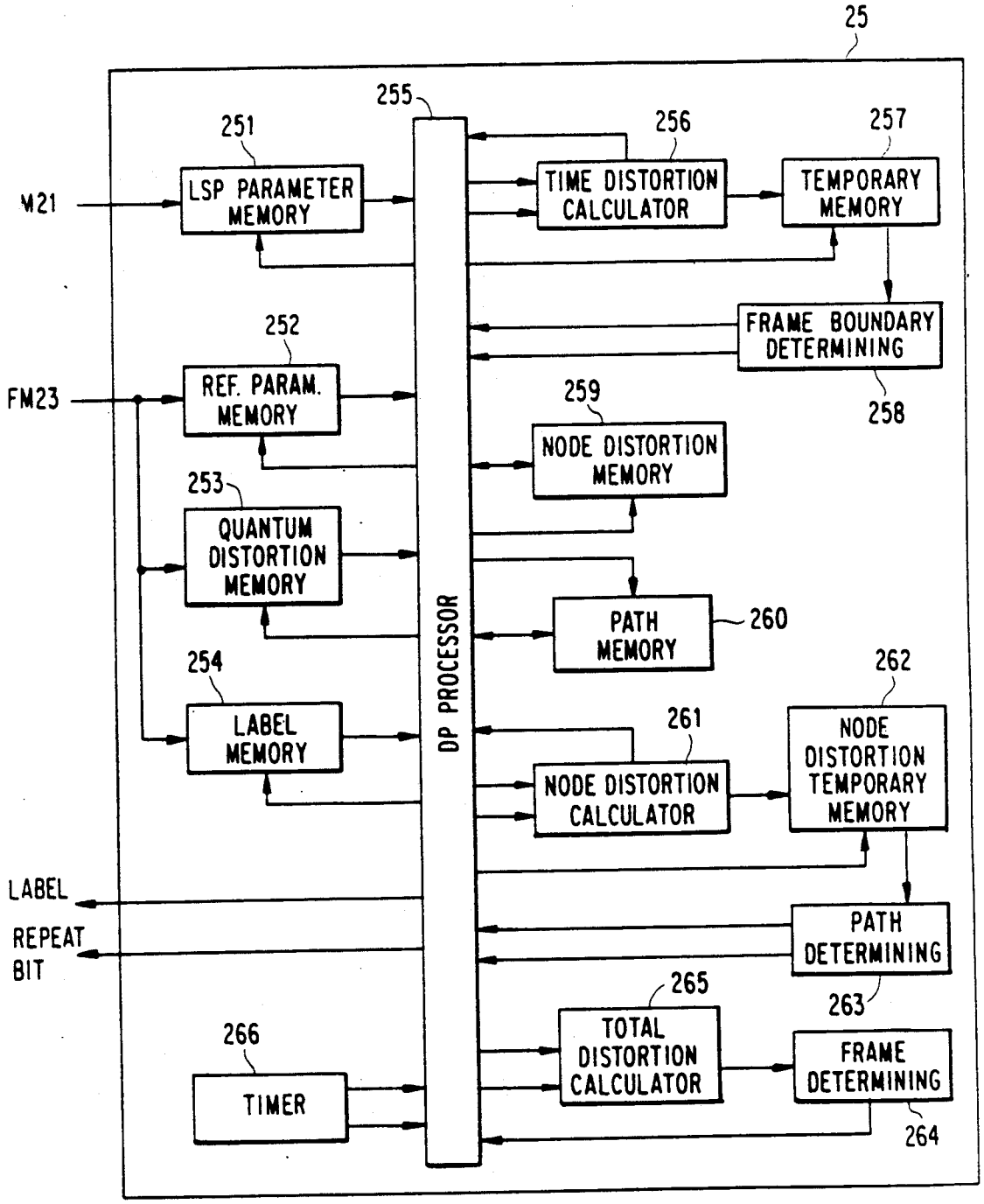
FIG. 6 shows a detailed block diagram of the frame selector in FIG. 4.

FIG. 6 is a detailed block diagram of the frame selector. The frame selector 25 comprises an LSP parameter memory 251, a reference parameter memory 252, a quantum distortion memory 253, a label memory 254, a DP controller 255, a time distortion calculator 256, a time distortion temporary memory 257, a frame boundary determining circuit 258, a node distortion memory 259, a path memory 260, a node distortion calculator 261, a node distortion temporary memory 262, a path determining circuit 263, a frame determining circuit 264, a total distortion calculator 265 and a timer 266.

The timer 266 generates a frame period signal of 10 msec and a section signal of 200 msec to the DP controller 255. The DP controller 255 is a microprocessor and controls everything in the frame selector 25, including, for example, initialization.

The LSP parameters of 10-th order obtained in the parameter analyzer 21 in FIG. 4 are supplied to the LSP parameter memory 251. In the memory 251, the LSP parameter is stored at the desired address specified by the frame number for each section.

The reference pattern parameter $P_k^{(SR)}$ (k=1, . . . 10), the quantum distortion $D_Q^{(q)}$ and the reference pattern label R are memorized in reference pattern memory 252, the quantum distortion memory 253, and label memory 254, respectively.

Now, when the seventh frame signal is supplied to the DP controller 255 from the timer 266, the DP controller 255 calculates the distortion corresponding to the first representative frame and memorizes it into the node distortion memory 259. For the sake of clarity, assuming the memory 259 has a size of two dimensional area (5,20), the quantum $D_1^{(q)}$ of the frame 1 is read out of the quantum distortion memory 253 and memorized in the node distortion memory 259 at the address of (1,1). Then, the quantum distortion $D_2^{(q)}$ of the frame 2 is read out of the quantum distortion memory 253 and is supplied to the node distortion calculator 261. The reference pattern parameter of the frame 2 and LSP parameter of the frame 1 are sent to the time distortion calculator 256.

The time distortion calculator 256 calculates the time distortion $d_{21}$ and applies it to the node distortion calculator 261.

The node distortion calculator 261 calculates the sum value $D_2^{(1)}$ of $D_2^{(q)}$ and $d_{2,1}$ and supplies the sum $D_2^{(1)}$ to the node distortion memory 259 at the address (1,2). Similarly, the quantum distortion $D_3^{(q)}$ from the quantum distortion memory 253 is applied to the node distortion calculator 261.

The time distortion calculator 256 calculates $d_{3,1}$ in response to the LSP parameter of the frame 1 from the LSP parameter memory 251 and supplies it to the node distortion calculator 261 where the $D_3^{(q)}$ and $d_{3,1}$ are summed.

The time distortion $d_{3,2}$ is developed in the time distortion calculator 256 and is accumulated as $D_3^{(1)}$ in Equation (13), $D_3^{(1)}$ is stored in the node distortion memory 259 at the address (1,3). In a similar way, $D_4^{(1)}$ through $D_7^{(1)}$ are accumulated in the node distortion calculator 261 and the accumulated result is stored in the node distortion memory 259 at the address (1,4) through (1,7).

The DP controller 255 develops the distortion corresponding to the second representative frame (to be memorized in the node distortion memory 259), DP path and frame boundary (to be memorized in the path memory 260) responsive to the 14-th frame signal. The quantum distortion $D_2^{(q)}$ of the frame 2 from the quantum distortion memory 253 is sent to the node distortion calculator 261.

Where the second representative frame is the frame 2, it follows that the first representative frame is the frame 1, and the DP path should be 1–2. The total distortion $D_2^{(2)}$ is $D_1^{(1)}+D_2^{(q)}$. In this embodiment, the DP path 1–2 and the frame boundary 1–2 are represented by the preceding frame 1 and the period 1 indicated by the preceding frame, respectively. In order to clarify the explanation, it is assumed that the path memory 260 has a size of three dimension area (5,20,2).

The total distortion $D_1^{(1)}$ from the node distortion memory 259 is sent to the distortion calculator 261 where $D_2^{(q)}$ and $D_1^{(1)}$ are summed and the summed result is stored in the node distortion memory 259 at the address of (2,2). The DP controller 255 writes data "1" into the path memory 260 at the addresses (2,2,1) and (2,2,2).

Next, the total distortion $D_3^{(2)}$ is calculated as follows:

The time distortions $d_{3,2}$ and $d_{1,2}$ are developed in the time distortion calculator 256 and are memorized in the time distortion temporary memory 257, which has a memory size of two dimensional area (20,2) at the addresses of (2,1) and (2,2), respectively.

The frame boundary determining circuit 258 compares $d_{3,2}$ with $d_{1,2}$ and selects the smaller one. This selected one is $D_{1,3}$ in Equation (12) and $D_{1,3}=d_{3,2}$ when $d_{3,2}<d_{1,2}$. The developed $D_{1,3}$ is then sent to the node distortion calculator 261. When $d_{3,2}<d_{1,2}$, the frame 2 is replaced with the frame 3, and "1" data is then memorized in the path memory 260 at the address of (2,3,2).

$D_1^{(1)}$ from the node distortion memory 259 and $D_3^{(q)}$ from the quantum distortion memory 253 are applied to the node distortion calculator 261 and added to the distortion $D_{1,3}$. The summed result $D_1^{(1)}+D_{1,3}+D_3^{(q)}$ is memorized at the address of (1). Then, $D_2^{(1)}$ and $D_3^{(q)}$ are applied to the node distortion calculator 261. The summed result $D_2^{(1)}+D_3^{(q)}$ is stored in the node distortion temporary memory 262 at the address of (2). The two distortions stored in the node distortion temporary memory 262 are applied to the path determining circuit 263. The path determining circuit 263 compares the two and selects the smaller one, i.e., $D_3^{(2)}$ in Equation (12).

The path determining circuit 263 supplies $D_3^{(2)}$ to the node distortion memory 259 at the address of (2,3) which outputs the path data "1" or "2" specifying the minimum distortion of the frame 3 to the DP controller 255. The DP controller 255 writes the path data into the path memory 260 at the address of (2,3,1) or writes the data "2" into the memory 260 in order to change the boundary data at the address of (2,3,2) in the path memory 260 if the path data shows "2".

Similarly, the total distortion $D_4^{(2)}$ is calculated as described below. First, the total distortion when the frame 1 is selected as the first representative frame is calculated and written into the temporary memory 262 at the address (1). The path data "1" and the frame boundary data "1", "2" or "3" are memorized in the path memory 260 at the addresses of (2,4,1) and (2,4,2), respectively. Then, the total distortion when the frame 2 is determined as the first representative frame is developed and stored in the memory 262 at the address of (2). The path determining circuit 263 compares the two distortions and selects the smaller one. If the distortion of the frame 2 is smaller, the contents at the addresses (2,4,1) and (2,4,2) are changed. After similar processings for the frame 3 are performed, the path determining circuit 263 develops $D_4^{(2)}$ and writes $D_4^{(2)}$ into the node distortion memory 259 at the address (2,4), $D_5^{(2)}$ through $D_{14}^{(2)}$ are successively developed in a similar way and as stored in the memory 259 at the addresses of (2,5) through (2,14). The path and the frame boundary data obtained through the node distortion calculation are written into the path memory 260 at the addresses of {(2,5,1), (2,5,2)} through {(2,14,1), (2,14,2)}.

On receiving the 18-th frame signal from the timer 266, the DP controller 255 develops the distortion corresponding to the third representative frame, the DP path and the frame boundary and memorizes them in the node distortion memory 259 and the path memory 260. Similarly, in response to the 19-th and 20-th frame signals, the distortions, DP paths and frame boundaries for the corresponding fourth and fifth representative frames are developed and memorized. As a result, at the addresses (5,14) through (5,20) in the node distortion memory 259 the sum of the time distortion and the quantum distortion is stored where the respective frames #14 through #20 are selected as the fifth representative frame. It should be noted here that $D_{14}^{(5)}$ does not include the time distortion, for example, caused by replacement of the frames #15 through #20 with the reference pattern when the frame #14 is selected as the fifth representative frame. Processing shown in Equation (17) is, therefore, required. In this embodiment, $$D_{14}^{(5)} + \sum_{i=5}^{20} d_{14,1}$$

is calculated.

The time distortion calculator 256 calculates the time distortion $d_{14,15}$ by using the reference pattern parameter of the frame #14 and the LSP parameter of the frame #15 and supplies the result $d_{14,15}$ to the total distortion calculator 265. Similarly, $d_{14,16}$, $d_{14,17}$, . . . $d_{14,20}$ are inputted to the total distortion calculator 265. The total distortion calculator 265 develops the sum of these distortions, i.e., $$D_{14}^{(5)} + \sum_{i=15}^{20} d_{14,1},$$

and memorizes the result into a RAM the frame determining circuit 264 at the address (14). Then, $$D_{15}^{(5)} + D_{14}^{(5)} + \sum_{i=16}^{20} d_{14,1},$$

. . . $D_{19}^{(5)}+d_{19,20}$ are written into the frame determining circuit 264 at the addresses (15) . . . (19). Finally, $D_{20}^{(5)}$ from the node distortion memory 259 is written into the RAM of the frame determining circuit 264 at the address (20).

The frame determining circuit 264 determines D according to Equation (17) and sends the corresponding frame number to the DP controller 255. The DP controller 255 determines five representative frames replacing 20 frames and the period to be replaced with these representative frames by using the frame number, the path data and the frame boundary data, and outputs the number of the frames to be replaced as the repeat bit and the reference pattern number corresponding to the representative frames as the label to the label memory 254. The label memory 254 supplies the label data to the DP controller 255 to reproduce the speech as described before.

It will be easily understood that the present invention is applicable to various kinds of speech processing apparatus.

What is claimed is:

1. A speech processing system for processing an input speech signal having a plurality of sections each including a plurality of signal frames, said system comprising:

first means for extracting feature parameters of said input speech signal for each signal frame;

second means for determining at least one representative frame for each said section approximating at least one of said plurality of signal frames included in said each section, the first appearing representative frame in a present section being determined on the basis of a plurality of said signal frames in said present section and the last representative frame in a preceding section; and third means for generating an output signal indicating information contained in said at least one representative frame and the number of said plurality of signal frames to be replaced with said at least one representative frame.

2. A speech processing system according to claim 1, wherein said second means determines said at least one representative frame for a particular section by selecting a signal frame having a minimum total distance between said selected signal frame and signal frames in said particular section to be replaced with said selected signal frame.

3. A speech processing system according to claim 1, wherein said second means determines a total distortion for all possible combinations of said plurality of signal frames and said last representative frame chosen as said representative frames for said present section and for all possible combinations of said plurality of signal frames to be replaced by said representative frames for said present section and provides to said third means information regarding a particular combination of representative frames and signal frames to be replaced by each representative frame which will result in minimum distortion.

4. A speech processing system according to claim 1, wherein said second means determines said at least one representative frame according to a dynamic programming method.

5. A speech processing system according to claim 1, wherein said at least one representative frame for a particular section comprises first and second representative frames each for approximating a different respective one of two consecutive neighboring signal frames in said particular section.

6. A speech processing system according to claim 1, wherein two of said plurality of signal frames in a particular section to be approximated by respective different representative frames are separated by at least one signal frame which is to be approximated by an interpolation between said different representative frames.

7. A speech processing system according to claim 1, wherein each said section includes a plurality of signal frames and each of said signal frames is included in only one of said sections.

8. A speech processing system according to claim 1, wherein said system includes an analysis section, containing said first, second and third means, for generating said output signal, a synthesis section responsive to said output signal for synthesizing said input speech, and means (3, 4, 5) for transmitting said output signal from said analysis section to said synthesis section.

9. A speech processing system according to claim 8, wherein said analysis side further includes means for generating additional signals in accordance with said input speech signal, and means for multiplexing said output signal and additional signals for transmission to said synthesis section.

10. A speech processing system for processing an input speech signal having a plurality of sections each including a plurality of signal frames, said system comprising:

first means for extracting feature parameters for each signal frame of said input speech signal;

second means for determining at least one representative frame for each section which approximates a plurality of signal frames in said section;

third means for determining a reference pattern having the minimum distance to said at least one representative frame and generating an output signal indicating the content of the reference pattern and the number of signal frames to be replaced with said reference pattern in accordance with a measure which is obtained by summing a time distortion and a quantum distortion caused by replacement of the signal frames with the representative frame and the reference pattern frame, respectively.

11. A speech processing system according to claim 10, wherein said second and third means comprise dynamic programming means.

12. A speech processing system according to claim 10, wherein said second means selects said at least one representative frame from among said plurality of signal frames in a present section and a final representative frame derived for a preceding section.

13. A speech processing system, comprising:

first means for receiving and processing an input speech signal to obtain a fist signal having a plurality of successive sections each including a plurality of signal frames of feature parameters;

second means for selecting for each section of said first signal at least one representative frame which approximates at least one of said plurality of signal frames in said each section;

third means for comparing a plurality of reference patterns to each said representative frame to determine a reference pattern corresponding to each representative frame; and fourth means for generating an output signal, indicating the content of said corresponding reference pattern and the number of said plurality of signal frames to be replaced with said reference pattern, in accordance with a measure which is obtained by summing a time distortion caused by replacement of said number of signal frames with the representative frame and a quantum distortion caused by replacement of said number of signal frames with the reference pattern.

14. A method of processing an input speech signal having a plurality of sections each including a plurality of signal frames, said method comprising the steps of:

extracting feature parameters of said input speech signal for each signal frame;

determining at least one representative frame for each said section approximating at least one of said plurality of signal frames included in said each section, the first appearing representative frame in a present section being determine on the basis of a plurality of said signal frames in said present section and the last representative frame in a preceding section; and generating an output signal indicating information contained in said at least one representative frame and the number of said plurality of signal frames to be replaced with said at least one representative frame.

15. A speech processing method according to claim 14, wherein said determining step comprises determining said at least one representative frame for a particular section by selecting a signal frame having a minimum total distance between said selected signal frame and signal frames in said particular section to be replaced with said selected signal frame.

16. A speech processing method according to claim 14, wherein said determining step comprises determining a total distortion for all possible combinations of said plurality of signal frames and said last representative frame chosen as said representative frames for said present section and for all possible combinations of said plurality of signal frames to be replaced by said representative frame and providing information regarding a particular combination of representative frames for said present section and signal frames to be replaced by each representative frame which will result in minimum distortion.

17. A speech processing method according to claim 14, wherein said determining step comprises determining said at least one representative frame according to a dynamic programming method.

18. A speech processing method according to claim 14, wherein said at least one representative frame for a particular section comprises first and second representative frames each for approximating a different respective one of two consecutive neighboring signal frames in said particular section.

19. A speech processing method according to claim 14, wherein two of said plurality of signal frames in a particular section to be approximated by respective different representative frames are separated by at least one signal frame which is to be approximated by an interpolation between said different representative frames.

20. A method of processing an input speech signal having a plurality of sections each including a plurality of signal frames, said method comprising the steps of:

extracting feature parameters for each signal frame of said input speech signal;

determining at least one representative frame for each section which approximates a plurality of signal frames in said section; and determining a reference pattern having the minimum distance to said at least one representative frame and generating an output signal indicating the content of the reference pattern and the number of signal frames to be replaced with said reference pattern in accordance with a measure which is obtained by summing a time distortion and a quantum distortion caused by replacement of the signal frames with the representative frame and the reference pattern frame, respectively.

21. A speech processing method according to claim 20, wherein both of said determining steps are performed according to a dynamic programming method.

22. A speech processing method according to claim 20, wherein said determining step comprises selecting said at least one representative frame from among said plurality of signal frames in said each section and a final representative frame derived for a preceding section.

* * * * *